US008951454B2

(12) United States Patent
Strozyk

(10) Patent No.: US 8,951,454 B2
(45) Date of Patent: Feb. 10, 2015

(54) METHOD FOR FORMING COVER LAYER FOR GOLF BALL CORE

(71) Applicant: Acushnet Company, Fairhaven, MA (US)

(72) Inventor: Richard Strozyk, Huntertown, IN (US)

(73) Assignee: Acushnet Company, Fairhaven, MA (US)

( * ) Notice: Subject to any disclaimer, the term of this patent is extended or adjusted under 35 U.S.C. 154(b) by 225 days.

(21) Appl. No.: 13/721,108

(22) Filed: Dec. 20, 2012

(65) Prior Publication Data

US 2014/0178586 A1 Jun. 26, 2014

(51) Int. Cl.

| | |
|---|---|
| ***B29C 43/28*** | (2006.01) |
| ***B29C 43/30*** | (2006.01) |
| ***B29C 47/02*** | (2006.01) |
| ***B29C 47/04*** | (2006.01) |

(52) U.S. Cl.
USPC ..... 264/149; 264/279.1; 264/294; 264/161; 264/162

(58) Field of Classification Search
None
See application file for complete search history.

(56) References Cited

U.S. PATENT DOCUMENTS

| | | | | |
|---|---|---|---|---|
| 695,867 | A | 3/1902 | Kempshall | |
| 1,883,704 | A * | 10/1932 | Goodwin | 156/213 |
| 1,937,104 | A * | 11/1933 | Thomsen | 264/171.14 |
| 2,484,965 | A * | 10/1949 | Slaughter | 264/149 |
| 2,575,138 | A * | 11/1951 | Slaughter | 53/452 |
| 5,480,155 | A * | 1/1996 | Molitor et al. | 473/354 |
| 5,779,968 | A * | 7/1998 | Richwine et al. | 264/515 |
| 6,117,025 | A | 9/2000 | Sullivan | |
| 6,461,461 | B2 * | 10/2002 | Kennedy, III | 156/147 |
| 6,767,940 | B2 | 7/2004 | Voorheis | |
| 6,818,701 | B2 * | 11/2004 | Ichikawa et al. | 525/106 |
| 6,960,630 | B2 | 11/2005 | Cavallaro et al. | |

FOREIGN PATENT DOCUMENTS

| | | | |
|---|---|---|---|
| JP | 5611656 | * | 9/1981 |
| KR | 2005/005327 | * | 1/2005 |

OTHER PUBLICATIONS

RD 307086, Nov. 1989.*

* cited by examiner

*Primary Examiner* — Edmund H. Lee
(74) *Attorney, Agent, or Firm* — Kristin D. Wheeler

(57) ABSTRACT

The present invention is directed to a method for forming golf balls, wherein an extruder forms a continuous tubing of cover material and a continuous stream of golf ball cores are fed into the tubing and translated to an encasement station wherein the tubing/cover material is wrapped around each core and the encased core sealed off by a twisting or crimping procedure. The resulting product is placed into a compression mold and a two piece golf ball can be created without the need for the costly process of injection molding.

13 Claims, 1 Drawing Sheet

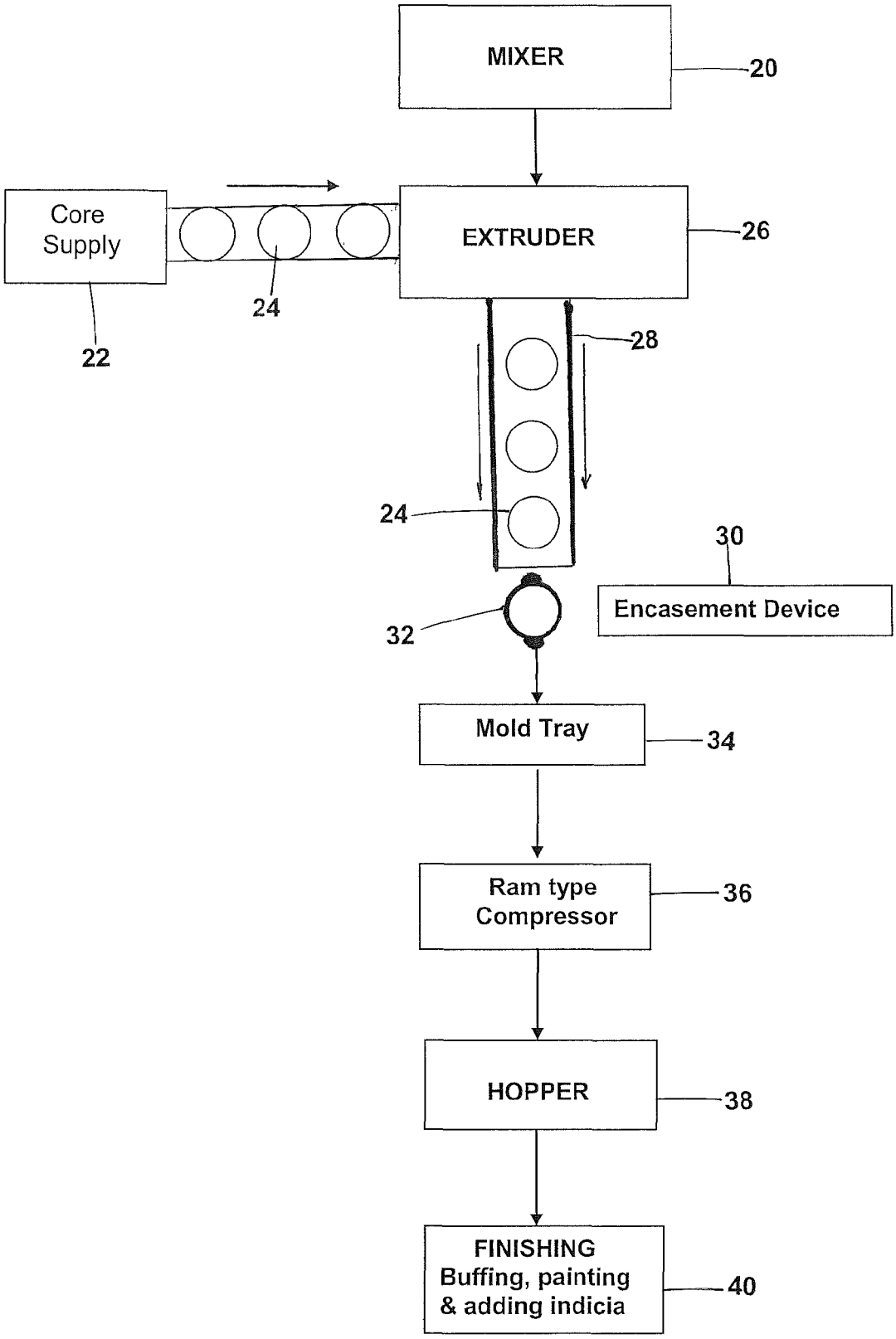
MIXER
20
Core Supply
EXTRUDER
26
24
22
28
24
30
Encasement Device
32
Mold Tray
34
Ram type Compressor
36
HOPPER
38
FINISHING Buffing, painting & adding indicia
40

METHOD FOR FORMING COVER LAYER FOR GOLF BALL CORE

FIELD OF THE INVENTION

The present invention relates to golf balls, specifically, to a golf ball having a cover layer placed over a core by encasing the core with extruded tubing.

BACKGROUND OF THE INVENTION

The manufacture of two-piece golf balls, i.e., golf balls with only a solid core ball and a dimpled outer shell, has normally been done in an injection molding process. In this process, the solid core is first placed inside of a mold cavity, a set of pins then pushes upward through the bottom of the cavity to raise the core to a central position, and a molten material is then forced into the cavity and around the core to form the outer shell.

Although this process makes well-formed balls, it is a difficult one to control and requires skilled operators. Also, it requires expensive tooling and expensive maintenance to the tooling. Ideally, it would be preferred if a less expensive process could be found.

While manufacturers have had to use injection molding to form the dimpled shell on two-piece balls, they have been able to use a much less expensive process of compression molding for forming a similar shell on three-piece balls, i.e., the traditional golf ball with a small rubber core ball surrounded by a mantle or intermediate layer and then the outer shell. Obviously, the manufacturers would prefer to use compression molding in forming two piece balls because the equipment and tooling are already available in their plants. Further, the general process of producing the outer shell would be less expensive because it would be easier to control and would therefore not require expensive, highly skilled operators.

Unfortunately, attempts to compression mold perfectly shaped, two-piece balls have failed because, unlike the wound centers of three-piece balls, the solid cores of two-piece balls are relatively incompressible. In 1902, Kempshall attempted to solve this problem by using telescopically mating dies to compression mold a dimpled cover for two-piece balls. As described in the Kempshall U.S. Pat. No. 695,867, he teaches a process of compression molding includes a pair of male and female dies. As shown in FIGS. 5-7 of the Kempshall patent, the female die has a rim or step C on which a small amount of the cover material extrudes when the dies are initially pushed together to form the cover. The overflow material is trapped between the approaching edges B and C of the two dies. Continued axial pressure on the dies causes the edges B and C to move toward one another and force the trapped material to flow back inside the mold cavity to create an integral dimpled cover for the ball.

While the Kempshall attempt was noteworthy, it has its drawbacks. As explained in the patent, the produced cover is not uniform because it has a welt at its equator. This welt prevents the ball from being consistently hit the same distance with any single golf club by an accomplished golfer. Since predictability in the length of a "shot" is important for a low score in golf, this lack of consistency and the welt which causes it are highly undesirable.

The inconsistency occurs when the "strike" of the golfer's club head hits against the welt. Because this portion of the cover is fatter than the rest, the strike creates less compression of the ball than it would if any other portion of the cover were struck. This lesser compression causes the ball to go a shorter distance than it would normally travel.

In addition to creating a welt, the compression molding process can allow the size of the welt to vary from ball to ball. Since the volume of the solid core for two-piece balls can vary substantially from one core to the next, it is difficult to precisely control the amount of cover stock extruded from the mold cavity during mating of the dies. With these molds, if a large core were encountered, an excessive amount of cover stock would be extruded and the same large amount would be forced back into the mold cavity with the result being an even larger deformation or welt at the center of the finished ball cover. Also, wear would occur on the approaching edges B and C of the dies because of the extra pressure placed on the edges by the increased bulk between them.

It is therefore the primary object of the present invention to provide an improved method for placing covers over two-piece golf balls by compression molding.

The above and other objects and advantages of this invention will become more readily apparent when the following description is read in conjunction with the accompanying drawings.

SUMMARY OF THE INVENTION

The present invention is directed to a method for forming golf balls, wherein a mixer blends multiple components to create a golf ball cover material. An extruder takes this material and forms a continuous tubing of cover material. A core supply feeds a continuous stream of cores into the tubing, which has an inside diameter to accommodate the cores. The translation of the cores within the tubing leads to an encasement station, wherein an encasing machine cuts the tubing on opposite sides of the core in such a manner that the tubing material wraps about the core and ties on opposing sides of the core, therein creating a cover about the core. The encasement may be done by various methods such as by crimping the tubing material, or by twisting the tubing material about the core, however, the main intent to seal the core with the tubing/cover material. The encased cores are then conveyed to a mold tray that is then placed into a compression mold such as a Ram compressor, whereupon by the application of heat and pressure within the mold, the plastic tubing material flows freely about the core to create the golf ball cover. The resulting product is then sent to a finishing procedure wherein the ball is buffed, flash removed, painted and identifying indicia printed on the ball.

It is an object of the invention that the encasement procedure creates a welt of material on opposing sides of the encased ball. This material to ensure that there is an ample amount of cover material, and any excess material (which creates flash about the ball perimeter) is useful in providing proper orientation during the buffing step.

One embodiment of the invention encases the core by either a crimping or twisting of the tubing about it.

Another object of the invention is to provide a golf ball which may have a multi-core construction and/or a multi-layered construction comprising inner or dual covers.

BRIEF DESCRIPTION OF THE DRAWING

FIG. 1 is schematic of the novel process of encasing a core with extruded tubing to create a golf ball.

DETAILED DESCRIPTION OF THE PREFERRED EMBODIMENT

Referring to the drawings in detail, FIG. 1 describes an improved process for placing a cover layer over a core to make a golf ball as illustrated. It is to be appreciated that the cover layer may also be an intermediate layer without distracting from the inventive concept.

The process, as depicted in FIG. 1, includes a mixer 20 wherein the ingredients for forming the cover material are mixed together. The resultant blend of material is then fed into an extruder 26 which creates a continuous extruded plastic tubing 28, while a core supply 22 provides a continuous supply of cores 24, which are simultaneously fed into a mechanism (not shown) that inserts them into the tubing material 28. The cores 24 and tubing 28 translate along to a position wherein an encasement device 30 cuts the tubing material 28 on opposing sides of the cores 24 and wraps the tubing material about the core 24, therein creating an encased core 32. The tubing material 28 may be wrapped about the cores 24 in either a crimping or twisting manner and still comply with the inventive integrity.

Upon carrying out the encasement procedure, welts of material 42 may be formed on either side of the cores 24. The encased cores 32 are then placed into cavity cups within a multiple mold tray 34, the extra welt material ensuring a sufficient amount of cover material is available. The mold trays 34 are moved to a compression station, wherein a Ram type compressor 36 subjects each ball 32 to temperatures between 350° F. to 700° F., and the cover material 28 is allowed to freely flow about the core 24 to create a recognizable dimpled golf ball. Any excess material (flashing) exits through vents in the cavity cups, which is very common in the industry and aids in orienting the balls during the finishing steps. Upon exiting the compression mold, the golf balls are placed into a hopper 38 to be transported to a finishing station 40. At the finishing station, the balls are buffed with the "flash" providing the proper orientation for the cutters and buffers. The remaining steps are the painting and addition of identifying indicia. It is to be noted that the present invention allows for two piece balls to be compression molded without the need to provide pre-formed cups which require the more difficult, expensive and labor-heavy injection molding. The method of the present invention could also be used for placing an intermediate layer about the core for a multi-layered ball.

Golf ball cores of the present invention can be single-, dual-, or multi-layer cores and generally have an overall diameter of from 1.50 inches to 1.62 inches, and preferably have an overall diameter of 1.50 inches. Dual-layer cores of the present invention generally have a inner core layer (or "center") having a diameter of from 0.50 inches to 1.55 inches and an outer core layer having a thickness of from 0.03 inches to 0.25 inches. Single-layer covers of the present invention generally have a thickness of from 0.025 inches to 0.090 inches.

In a preferred embodiment, the present invention is directed to an improved golf ball which comprises a core, and a cover. Preferably, the core has a compression ranging from about 10 to about 100. The core preferably has a diameter of about 1.00 inch to about 1.65 inches, more preferably about 1.25 inches to about 1.60 inches, and most preferably about 1.40 inches to about 1.58 inches. The cover is typically formed of one layer, but inner and outer cover layers are not excluded. It is preferred that a finished golf ball made with such a core has a COR of greater than about 0.75, more preferably about 0.78 to about 0.85 and most preferably about 0.79 to about 0.82.

In a preferred embodiment, the present invention provides a two-piece golf ball having a compression molded rubber core and a compression molded cover layer.

Suitable materials for golf ball core, include, but are not limited to, polyethylene, including, for example, low density polyethylene, linear low density polyethylene, and high density polyethylene; polypropylene; rubber-toughened olefin polymers; copolyether-esters; copolyether-amides; polycarbonates; acid copolymers which do not become part of an ionomeric copolymer; plastomers; flexomers; vinyl resins, such as those formed by the copolymerization of vinyl chloride with vinyl acetate, acrylic esters or vinylidene chloride; styrene/butadiene/styrene block copolymers; styrene/ethylene-butylene/styrene block copolymers; acrylonitrile-butadiene-styrene polymers; fluoropolymers; dynamically vulcanized elastomers; ethylene vinyl acetates; ethylene methacrylates and ethylene ethacrylates; ethylene methacrylic acid, ethylene acrylic acid, and propylene acrylic acid; polyvinyl chloride resins; copolymers and homopolymers produced using a metallocene or other single-site catalyst; polyamides, amide-ester elastomers, and graft copolymers of ionomer and polyamide, including, for example, Pebax® thermoplastic polyether block amides, commercially available from Arkema Inc; polyphenylene oxide resins or blends of polyphenylene oxide with high impact polystyrene, such as NORYL®, commercially available by General Electric Company of Pittsfield, Mass.; crosslinked transpolyisoprene blends; polyurethanes; polyureas; polyester-based thermoplastic elastomers, such as Hytrel®, commercially available from E.I. du Pont de Nemours and Company, and LOMOD®, commercially available from General Electric Company; polyurethane-based thermoplastic elastomers, such as Elastollan®, commercially available from BASF; natural and synthetic rubbers; partially and fully neutralized ionomers; and combinations thereof. Suitable golf ball materials and constructions also include, but are not limited to, those disclosed in U.S. Pat. Nos. 6,117,025, 6,767,940, and 6,960,630, the entire disclosures of which are hereby incorporated herein by reference.

A representative solid core composition in accordance with the present invention comprises an elastomeric polymer ("base rubber"), a crosslinking agent, and a free radical initiator. The base rubber typically includes natural or synthetic elastomers such as natural rubbers; balata; gutta-percha; synthetic polyisoprenes; styrene-butadiene rubbers; styrene-propylene-diene rubbers; chloroprene rubbers; acrylonitrile rubbers; acrylonitrile-butadiene rubbers; ethylene-propylene-diene terpolymers ("EPDM"); metallocene rubbers, and mixtures thereof. The elastomeric composition may also comprise polypropylene resins; partially or fully neutralized ionomer resins; polyamides; polyesters; urethanes; polyureas; thermosetting or thermoplastic elastomers such as Pebax® (AtoFina), Hytrel® (DuPont) and Kraton® (Shell Chemical); styrene-ethylene block copolymers; maleic anhydride or succinate modified metallocene catalyzed ethylene copolymers; chlorinated polyethylenes; polysulfide rubbers; fluorocarbons; and mixtures thereof.

Preferably, the base rubber comprises at least about 40 pph by weight of at least one polybutadiene synthesized with cobalt, nickel, neodymium, and/or lithium catalysts. The polybutadiene preferably has a cis-1,4 content of at least about 90%, more preferably at least about 95%. Also preferably, the polybutadiene has a Mooney viscosity of at least about 30, a molecular weight of at least about 150,000 and a polydispersity of less than about 4.0. The base rubber may comprise a blend of two or more polybutadiene rubbers having different weight percentages, catalysts, molecular weights, Mooney viscosity, polydispersity, filler contents, crosslinking agent contents, or cis- and trans-isomer contents.

The cross-linking agent may be formed from salts of α,β-ethylenically unsaturated carboxylic acids having about 3 to about 8 carbon atoms, such as methacrylic, acrylic, cinnamic, crotonic, formanic and maleic acids. Other cross-linking agents include unsaturated vinyl compounds. More preferably, the cross-linking agent is a mono-(meth)acrylic acid or di-(meth)acrylic acid metal salt, wherein the cation is zinc, sodium, magnesium, or mixtures thereof. Even more preferably, the cross-linking agent is zinc diacrylate ("ZDA"), zinc dimethacrylate ("ZDMA"), or mixtures thereof. Of the common acrylate cross-linkers, ZDA has generally been found to produce golf balls with greater initial velocity than ZDMA, therefore, the former is most preferred. The crosslinking agent may be present in an amount from about 0 to about 70 pph of the base rubber. Base rubbers having little or no ZDA has low water vapor transmission rates. They are less prone to moisture absorption and related deterioration in playability and performance because of the low permeability. On the other hand, high levels of ZDA (greater than about 40 pph) provide desirable increases in initial velocity and COR to the base rubber.

The polybutadiene rubber may be mixed with a cis-to-trans catalyst and an optional accelerator during molding to increase resilience and/or decrease compression of the golf ball cores formed therefrom. Suitable materials for the cis-to-trans catalyst and accelerator are disclosed in U.S. Pat. Nos. 6,291,592 and 6,162,135, the disclosures of which are incorporated herein by reference in their entirety. Other core additives well known to the skilled artisan include fillers to adjust the density and/or specific gravity of the core, antioxidants to prevent the breakdown of the base rubber, processing aids, processing oils, plasticizers, dyes and pigments.

Preferably, the cover material 28 is comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof. Still further, the cover material 28 is preferably comprised of a polyether or polyester thermoplastic urethane, a thermoset polyurethane, a low modulus ionomer such as acid-containing ethylene copolymer ionomers, including E/X/Y terpolymers where E is ethylene, X is an acrylate or methacrylate-based softening comonomer present in 0-50 weight percent and Y is acrylic or methacrylic acid present in 5-35 weight percent. More preferably, in a low spin rate embodiment designed for maximum distance, the acrylic or methacrylic acid is present in 15-35 weight percent, making the ionomer a high modulus ionomer. In a high spin embodiment, the acid is present in 10-15 weigh percent or a blend of a low modulus ionomer with a standard ionomer is used.

For purposes of the present disclosure, COR is determined according to a known procedure wherein a sphere is fired from an air cannon at two given velocities and calculated at a velocity of 125 ft/s. Ballistic light screens are located between the air cannon and the steel plate at a fixed distance to measure sphere velocity. As the sphere travels toward the steel plate, it activates each light screen, and the time at each light screen is measured. This provides an incoming transit time period inversely proportional to the sphere's incoming velocity. The sphere impacts the steel plate and rebounds though the light screens, which again measures the time period required to transit between the light screens. This provides an outgoing transit time period inversely proportional to the sphere's outgoing velocity. COR is then calculated as the ratio of the outgoing transit time period to the incoming transit time period, $COR=V_{out}/V_{in}=T_{in}/T_{out}$.

While it is apparent that the illustrative embodiments of the invention disclosed herein fulfill the preferred embodiments of the present invention, it is appreciated that numerous modifications and other embodiments may be devised by those skilled in the art. Examples of such modifications include placement of intermediate or cover layers about a multi-layered core. Therefore, it will be understood that the appended claims are intended to cover all such modifications and embodiments, which would come within the spirit and scope of the present invention.

What is claimed is:

1. A method for forming golf balls, the process comprising:

(a) mixing components to form a cover material;

(b) extruding the cover material in the form of a continuous plastic tubing having an inner diameter of a size to accommodate golf ball cores;

(c) providing a continuous line of golf ball cores into the plastic tubing;

(d) encasing the golf ball core by wrapping and cutting the plastic tubing on opposing sides of the core;

(e) placing each encased core into a pair of opposing hemispherical cavity cups of a mold tray;

(f) heating and compressing the encased cores wherein the cover material freely flows about the cores to form covered golf balls;

(g) finishing the covered golf balls by buffing, painting and applying indicia to the covers.

2. The method of claim 1, wherein the encasing of the core creates a welt of material on opposing sides of the encased ball.

3. The method of claim 2, wherein the core encasement is accomplished by crimping the tube about the core.

4. The method of claim 2, wherein the core encasement is accomplished by twisting the tube about the core.

5. The method of claim 1, wherein the heating is accomplished at temperatures between 350° F. to 600° F.

6. The method of claim 1, wherein the cover material is comprised of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof.

7. The method of claim 1, wherein the core is comprised of an elastomeric polymer, a crosslinking agent, and a free radical initiator.

8. The method of claim 7, wherein the elastomeric polymer typically includes natural or synthetic elastomers such as natural rubbers; balata; gutta-percha; synthetic polyisoprenes; styrene-butadiene rubbers; styrene-propylene-diene rubbers; chloroprene rubbers; acrylonitrile rubbers; acrylonitrile-butadiene rubbers; ethylene-propylene-diene terpolymers; metallocene rubbers; polypropylene resins; partially or fully neutralized ionomer resins; polyamides; polyesters; urethanes; polyureas; styrene-ethylene block copolymers;

maleic anhydride or succinate modified metallocene catalyzed ethylene copolymers; chlorinated polyethylenes; polysulfide rubbers; fluorocarbons; and mixtures thereof.

9. The method of claim 1, wherein the core has a diameter of 1.50 inches to 1.62 inches.

10. The method of claim 1, wherein the cover has a thickness of 0.025 inch to 0.09 inch.

11. The method of claim 1, wherein the finished golf ball has a COR between 0.78 and 0.82.

12. The method of claim 1, wherein the finished ball has a multi-piece core.

13. The method of claim 1, wherein the finished ball further has an inner cover layer.

* * * * *